United States Patent [19]

Holt et al.

[11] Patent Number: 4,937,713

[45] Date of Patent: Jun. 26, 1990

[54] FLASHLIGHT WITH A PIVOTAL HOOD

[76] Inventors: Timothy R. Holt; Debra L. Holt, both of 3008 Mary La., Escondido, Calif. 92025

[21] Appl. No.: 396,103

[22] Filed: Aug. 21, 1989

[51] Int. Cl.[5] ..... F21L 7/00

[52] U.S. Cl. ..... 362/186; 362/199; 362/205

[58] Field of Search ..... 362/186, 190, 199, 202, 362/205, 282, 421, 427

[56] References Cited

U.S. PATENT DOCUMENTS

| | | | |
|---|---|---|---|
| 1,124,903 | 1/1915 | Howe | 362/421 X |
| 1,280,370 | 10/1918 | Beckmann | 362/199 |
| 2,166,282 | 7/1939 | Benjafield | 362/186 X |
| 2,205,163 | 6/1940 | Blau | 362/199 |
| 2,401,366 | 6/1946 | Muldoon | 362/199 |
| 2,796,516 | 6/1957 | Martschik | 362/199 |
| 3,393,312 | 7/1968 | Dahl | 362/205 |
| 4,058,719 | 11/1977 | Chopp | 362/190 |
| 4,399,498 | 8/1983 | Bacevius | 362/190 |
| 4,443,831 | 4/1984 | Godfrey et al. | 362/190 |
| 4,533,982 | 8/1985 | Kozar | 362/202 |

*Primary Examiner*—Ira S. Lazarus
*Assistant Examiner*—Peggy Neils
*Attorney, Agent, or Firm*—Jerry T. Kearns

[57] ABSTRACT

A flashlight has a spherical end portion including a spherically curved transparent lens. A frusto conical hood formed from a resilient rubber material is received in surrounding relation on the spherical portion and includes a socket forming a ball and socket pivotal connection with the spherical portion. The hood forms a glare shield around the flashlight lens and is designed for abutment with a window pane. Relative pivotal movement of the body portion of the flashlight with respect to the hood allows an individual to direct a light beam in a variety of directions through a window pane without being subject to a reflective glare.

2 Claims, 4 Drawing Sheets

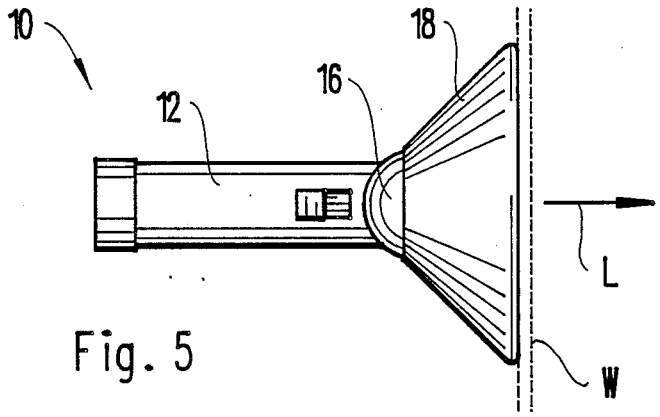
Fig. 5
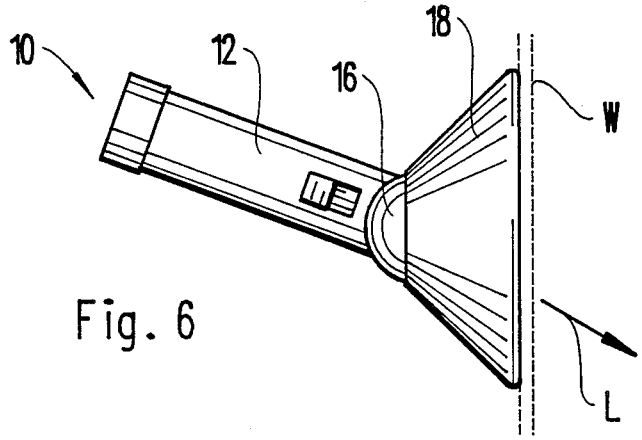
Fig. 6
Fig. 7
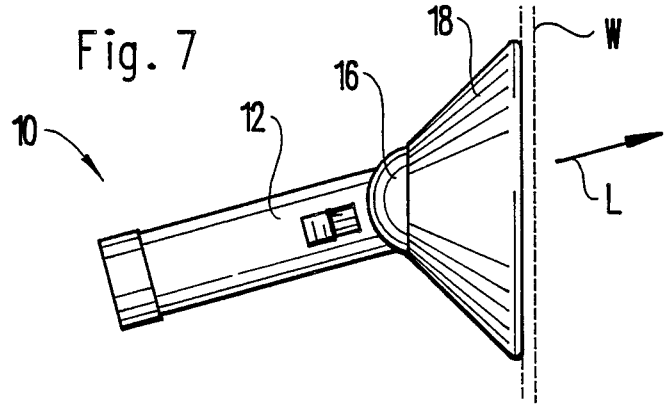

FLASHLIGHT WITH A PIVOTAL HOOD

BACKGROUND OF THE INVENTION

1. Field of the Invention

The present invention relates to flashlights, and more particularly pertains to a flashlight with a pivotal glare shielding hood. With increasing crime rates throughout the country, individuals are becoming more security conscious. Frequently, individuals find it necessary to investigate exterior noises and other disturbances occurring in close proximity to their home. Conventionally, an individual shines the beam from a flashlight through a window pane in an attempt to illuminate the exterior area surrounding their home. This practice results in a blinding reflective glare from the window pane, which is exacerbated by the reflection of the light beam from dust particles within the home, between the flashlight lens and window. In order to overcome these problems, the present invention provide a flashlight with a pivotal hood formed from a resilient material and adapted for abutment with a window pane.

2. Description of the Prior Art

Various tYpes of flashlights are known in the prior art. A tYpical example of such a flashlight is to be found in U.S. Pat. No. 3,393,312, which issued to F. Dahl on July 16, 1968. This patent discloses an adjustable flashlight which is flexibly connected to a battery enclosing handle portion. The head of the flashlight is detachably mounted to the batterY enclosing portion and includes an on/off switch to prevent damage from battery corrosion. U.S. Pat. No. 4,058,719, which issued to P. Chopp on Nov. 15, 1977, discloses an adjustable flashlight holder for supporting a conventional flashlight at a variety of different angles. U.S. Pat. No. 4,399,498, which issued to J. Bacevius on Aug. 16, 1983, discloses a flashlight having a light emitting lens at one end and a clamping member at an opposite end for securing the flashlight in a desired location. U.S. Pat. No. 4,443,831, which issued to T. Godfrey et al on Apr. 17, 1984, discloses a portable auxiliary light including a case and a light house at one end of the case. A bellows connects the case and light house for relative adjustment. U.S. Pat. No. 4,533,982, which issued to J. Kozar on Aug. 6, 1985, discloses a flashlight having a pivotal head portion connected to an elongated battery casing by a ball and socket connection.

While the above mentioned devices are directed to flashlights, none of these devices disclose a flashlight with a pivotal glare shielding hood formed from a resilient material adapted for abutment with an interior surface of a window pane to allow an individual to direct a light beam in a variety of directions through the window pane. Inasmuch as the art is relatively crowded with respect to these various types of flashlights, it can be appreciated that there is a continuing need for and interest in improvements to such flashlights, and in this respect, the present invention addresses this need and interest.

SUMMARY OF THE INVENTION

In view of the foregoing disadvantages inherent in the known types of flashlights now present in the prior art, the present invention provides an improved flashlight with a pivotal hood. As such, the general purpose of the present invention, which will be described subsequently in greater detail, is to provide a new and improved flashlight with a pivotal hood which has all the advantages of the prior art flashlights and none of the disadvantages.

To attain this, a representative embodiment of the concepts of the present invention is illustrated in the drawings and makes use of a flashlight having a spherical end portion including a spherically curved transparent lens. A frusto conical hood formed from a resilient rubber material is received in surrounding relation on the spherical portion and includes a socket forming a ball and socket pivotal connection with the spherical portion. The hood forms a glare shield around the flashlight lens and is designed for abutment with a window pane. Relative pivotal movement of the body portion of the flashlight with respect to the hood allows an individual to direct a light beam in a variety of directions through a window pane without being subject to a reflective glare.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseologY and terminology employed herein are for the purpose of description and should not be regarded as limiting. As such, those skilled in the art will appreciate that the conception, upon which this disclosure is based, may readilY be utilized as a basis for the designing of other structures, methods and systems for carrying out the several purposes of the present invention. It is important, therefore, that the claims be regarded as including such equivalent constructions insofar as theY do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quicklY from a cursory inspection the nature and essence of the technical disclosure of the application. The abstract is neither intended to define the invention of the application, which is measured bY the claims, nor is it intended to be limiting as to the scope of the invention in any way.

It is therefore an object of the present invention to provide a new and improved flashlight with a pivotal hood which has all the advantages of the prior art flashlights and none of the disadvantages.

It is another object of the present invention to provide a new and improved flashlight with a pivotal hood which may be easily and efficiently manufactured and marketed.

It is a further object of the present invention to provide a new and improved flashlight with a pivotal hood which is of a durable and reliable construction.

An even further object of the present invention is to provide a new and improved flashlight with a pivotal hood which is susceptible of a low cost of manufacture with regard to both materials and labor, and which accordinglY is then susceptible of low prices of sale to the consuming public, therebY making such flashlights economically available to the buying public.

Still Yet another object of the present invention is to provide a new and improved flashlight with a pivotal hood which provides in the apparatuses and methods of the prior art some of the advantages thereof, while simultaneously overcoming some of the disadvantages normally associated therewith.

Still another object of the present invention is to provide a new and improved flashlight with a pivotal hood to enable individuals to safety and effectively investigate noises and other disturbances in close proximity to their home.

Yet another object of the present invention is to provide a new and improved flashlight with a pivotal hood which allows an individual to direct a light beam in a variety of directions through a window pane.

Even still another object of the present invention is to provide a new and improved flashlight with a pivotal hood to allow an individual to project a light beam through a window pane without creating a blinding reflective glare.

These together with other objects of the invention, along with the various features of novelty which characterize the invention, are pointed out with particularitY in the claims annexed to and forming a part of this disclosure. For a better understanding of the invention, its operating advantages and the specific objects attained by its uses, reference should be made to the accompanYing drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 illustrates the manner of use of the flashlight to direct a light beam in a perpendicular direction through a window pane.

FIG. 6 illustrates the manner of use of the flashlight to direct a light beam in a downward oblique direction through a window pane.

FIG. 7 illustrates the manner of use of the flashlight to direct a light beam in an upward oblique direction through a window pane.

DESCRIPTION OF THE PREFERRED EMBODIMENT

Figure 1:
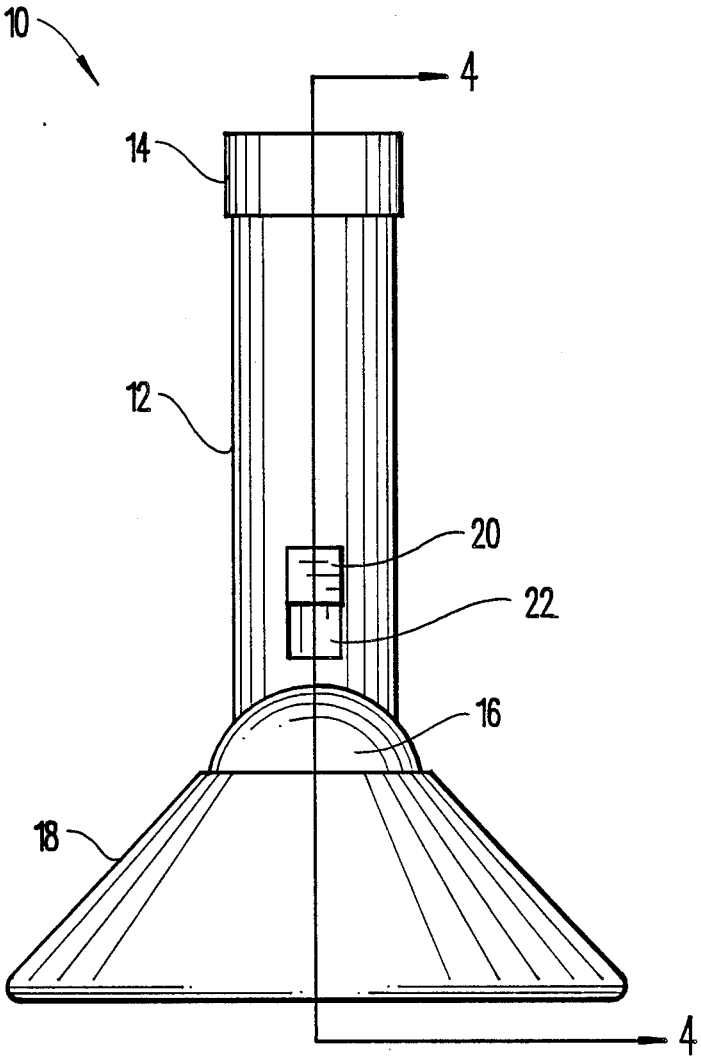
FIG. 1 is a side elevational view of the flashlight of according to the present invention.

With reference now to the drawings, and in particular to FIG. 1 thereof, a new and improved flashlight with a pivotal hood embodying the principles and concepts of the present invention and generally designated by the reference numeral 10 will be described.

More specifically, it will be noted that the first embodiment 10 of the invention includes an elongated hollow cylindrical body member 12 having a threaded end cap 14 at one end to provide access for the installation and removal of conventional dry cell batteries. A spherical portion 16 is formed at an opposite end of the body member 12 and forms a ball and socket pivotal connection with a frusto conical hood 18. The hood 18 is preferably formed from a resilient material such as rubber. A switch 20 is slidably mounted through a rectangular slot 22 formed in a side wall of the body 12.

Figure 2:
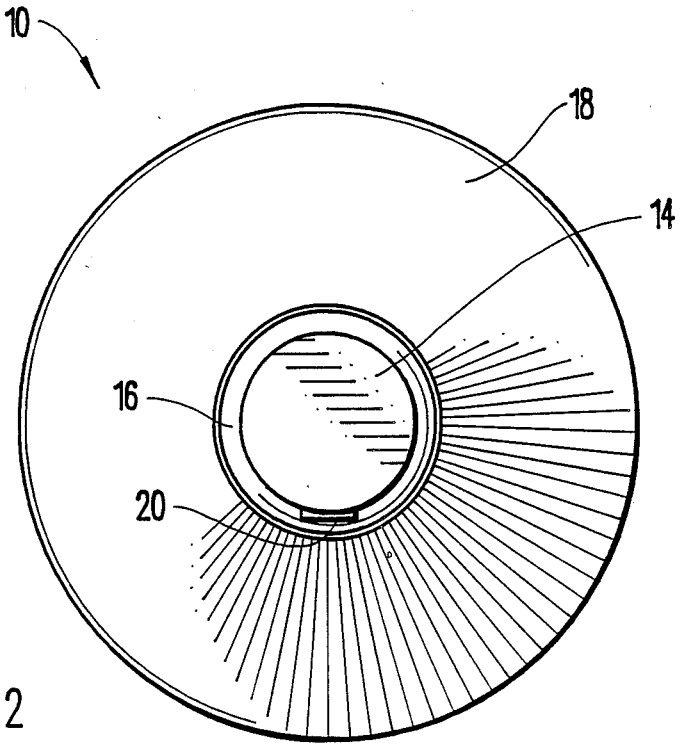
FIG. 2 is a top plan view of the flashlight of FIG. 1.

FIG. 2 is a top plan view of the flashlight 10.

Figure 3:
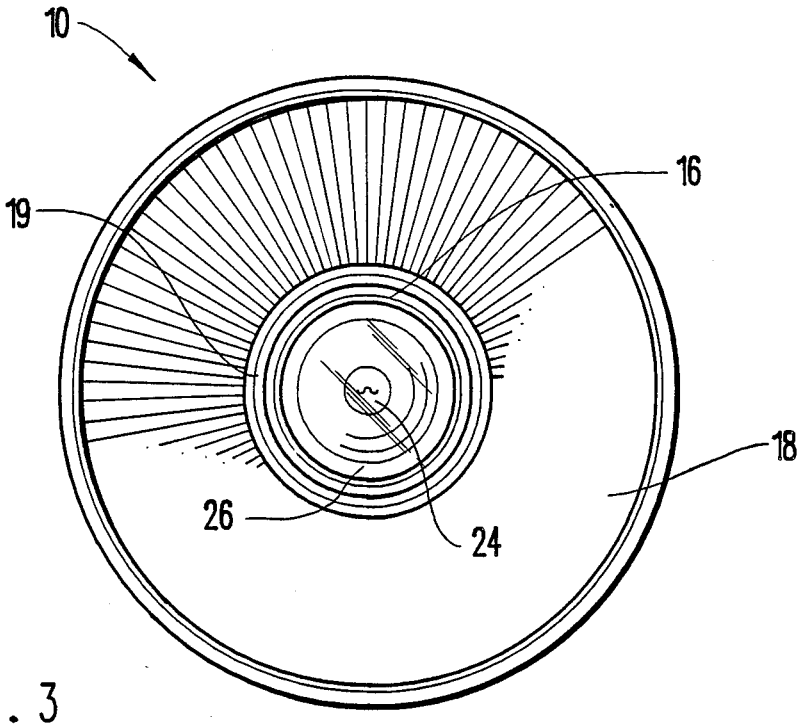
FIG. 3 is a bottom end plan view of the flashlight of FIG. 1.

FIG. 3 is a bottom end plan view which illustrates the interior of the frusto conical hood 18. A resilient ring 19 is secured within the hood 18 and is in abutment with an end portion of the spherical member 16. The ring 19 restrains axial movement between the spherical member 16 and the hood 18. The spherical member 16 has an aperture provided in a distal end portion which is covered by a transparent sphericallY curved lens 26 which encloses a conventional electric lamp 24.

Figure 4:
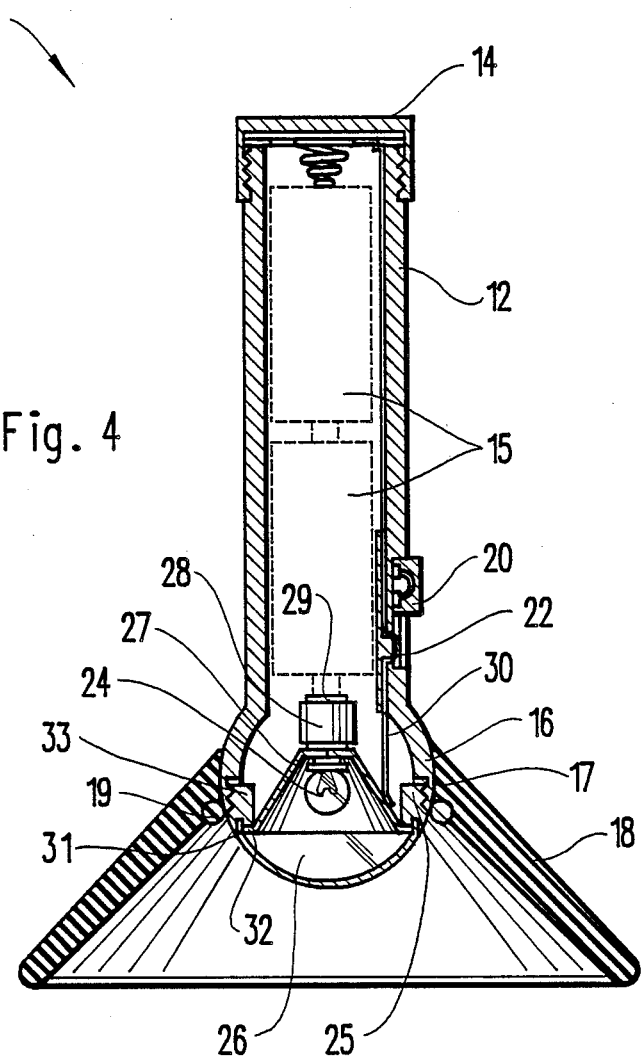
FIG. 4 is a longitudinal cross sectional view, taken along line 4—4 of FIG. 1.

FIG. 4 is a cross sectional view of the flashlight 10 which illustrates a pair of conventional batteries 15 received within the interior of the cylindrical body member 12. An externally threaded connector ring 25 is received in threaded engagement with internal threads formed within the distal end portion of the spherical member 16. The connector ring 25 supports the spherically curved lens 26 which has flanged end portions 31 secured to the ring 25. A frusto conical metallic reflector 27 includes a socket 28 which mounts the lamp 24. The socket 28 includes a first contact 29 disposed in abutment with one terminal of the innermost batterY 15. The second contact for the lamp 24 is formed by the inner surface of the metal reflector 27 and is adapted for selective contact with a slidable contact 30 connected in a conventional manner with an outer end of the outermost battery 15. The slidable contact 30 is selectively extended and retracted by the switch 20 to selectively illuminate the lamp 24. The reflector 27 includes a radially extending flange 32 disposed in abutment with an outer face 33 of the connector ring 25. The frusto conical hood 18 has a spherically curved socket portion 17 dimensioned for cooperative engagement with the spherical member 16 to form a pivotal ball and socket connection between the hood 18 and the flashlight body 12. The hood 18 may be formed from a variety of resilient materials, including plastic, rubber or a relatively stiff sponge rubber material.

As illustrated in FIG. 5, the widest end of the hood 18 terminates in a circular rim adapted for abutment on the inner surface of a glass window pane W. The flashlight body portion 12 may be oriented coaxially with the hood 18 to direct a light beam L in a perpendicular direction through the window pane W. The hood 18 protects an individual holding the body 12 from a reflective glare of the light beam from the window pane W.

As shown in FIG. 6, the body 12 maY be selectively pivoted with respect to the hood 18 to direct the light beam L in a downward oblique direction. Because of the resilient nature of the hood 18, the window pane W is protected from scratching, while a frictional engagement between the circular rim of the hood 18 prevents relative sliding between the hood 18 and the window pane W.

FIG. 7 illustrates the body 12 oriented to direct the light beam L in an upward oblique direction through the window pane W.

As may now be understood, the present invention provides an extremely versatile spotlight system which allows an individual to safely investigate exterior disturbances occurring around their home, without being subject to the blinding glare created by shining a conventional flashlight through a window pane. Additionally, the pivotal hood provides a supporting aid which allows an individual to shine a steady light beam in any selected direction.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A flashlight with a pivotal hood, comprising:
an elongated hollow cylindrical body member;
a generally spherical portion on one end of said body member;
an aperture formed through a distal end of said spherical portion;
an internal thread formed in said spherical portion, adjacent said aperture;
an externally threaded connector ring in threaded engagement within said aperture;
a lens having a spherically curved surface secured over said aperture by said connector ring, said lens having a curvature matching said spherical portion;
a metallic reflector centrally supported in said spherical portion by said connector ring;
an electric lamp mounted in a socket on said reflector;
a plurality of batteries in said hollow body member, an inner one of said batteries having a terminal in abutment with a contact on said socket;
a switch mounted exteriorly on said body member, said switch connected to a slidable contact;
said slidable contact selectively engageable with an inner surface of said reflector, said reflector electrically connected to said lamp;
a threaded end cap on an end of said body member opposite said spherical portion;
a frusto conical hood formed from a rubber material and received in surrounding relation on said spherical portion;
said hood having a narrow end forming a socket in engagement with said spherical portion, forming a ball and socket pivotal connection;
an internal resilient ring on said hood, surrounding said spherical portion to restrain relative axial movement between said spherical portion and said hood;
and
said hood having a wide end terminating in a circular rim adapted for abutment with a window pane, whereby an individual may pivot said body member and spherical portion relative to said hood to direct a light beam in various directions through a window pane.

2. A flashlight with a pivotal hood, comprising:
an elongated hollow body member;
a generally spherical portion on one end of said body member;
an aperture formed through a distal end of said spherical portion;
an internal thread formed in said spherical portion, adjacent said aperture;
an externally threaded connector ring in threaded engagement within said aperture;
a lens having a spherically curved surface secured over said aperture by said connector ring, said lens having a curvature matching said spherical portion;
a metallic reflector centrally supported in said spherical portion by said connector ring;
an electric lamp mounted in a socket on said reflector;
an electric power source in said hollow body member, a first terminal of said electric power source connected with a contact on said socket;
a switch mounted exteriorly on said body member, said switch connected to a slidable contact;
said slidable contact electrically connected to a second terminal of said electric power source and selectively engageable with an inner surface of said reflector, said reflector electrically connected to said lamp;
a frusto conical hood formed from a rubber material and received in surrounding relation on said spherical portion;
said hood having a narrow end forming a socket in engagement with said spherical portion, forming a ball and socket pivotal connection;
an internal resilient ring on said hood, surrounding said spherical portion to restrain relative axial movement between said spherical portion and said hood;
and
said hood having a wide end terminating in a circular rim adapted for abutment with a window pane, whereby an individual may pivot said body member and spherical portion relative to said hood to direct a light beam in various directions through a window pane.

* * * * *